US010077687B2

(12) United States Patent
Stone et al.

(10) Patent No.: US 10,077,687 B2
(45) Date of Patent: Sep. 18, 2018

(54) DESMODROMIC VALVE SYSTEMS AND METHODS OF OPERATION THEREOF

(71) Applicant: Camcon Auto Limited, Cambridgeshire (GB)

(72) Inventors: Roger Derrick Stone, East Sussex (GB); Owen James Warren Evans, East Sussex (GB)

(73) Assignee: Camcon Auto Limited, Cambridgeshire (GB)

( * ) Notice: Subject to any disclaimer, the term of this patent is extended or adjusted under 35 U.S.C. 154(b) by 47 days.

(21) Appl. No.: 14/786,685

(22) PCT Filed: Apr. 22, 2014

(86) PCT No.: PCT/GB2014/051239

§ 371 (c)(1),
(2) Date: Oct. 23, 2015

(87) PCT Pub. No.: WO2014/174268

PCT Pub. Date: Oct. 30, 2014

(65) Prior Publication Data

US 2016/0153323 A1 Jun. 2, 2016

(30) Foreign Application Priority Data

Apr. 23, 2013 (GB) ..... 1307317.6

(51) Int. Cl.
*F01L 1/18* (2006.01)
*F01L 1/30* (2006.01)
*F01L 3/10* (2006.01)

(52) U.S. Cl.
CPC .. *F01L 1/30* (2013.01); *F01L 3/10* (2013.01)

(58) Field of Classification Search
CPC ..... F01L 1/18; F01L 1/30; F01L 3/10
(Continued)

(56) References Cited

U.S. PATENT DOCUMENTS

| | | | |
|---|---|---|---|
| 3,183,901 | A | 5/1965 | Thuesen |
| 2003/0098001 | A1 | 5/2003 | Lau |
| 2007/0006835 | A1 | 1/2007 | Decuir, Jr. |

FOREIGN PATENT DOCUMENTS

| | | | |
|---|---|---|---|
| GB | 281082 | A | 12/1927 |
| GB | 294427 | A | 7/1928 |

(Continued)

OTHER PUBLICATIONS

Espacenet, English Machine Translation of WO02090728A1, dated Nov. 14, 2002, retrieved from http://worldwide.espacenet.com on Oct. 12, 2015 (9 pages).

(Continued)

*Primary Examiner* — Ching Chang
(74) *Attorney, Agent, or Firm* — Wood Herron & Evans LLP

(57) ABSTRACT

An assembly for coupling a valve stem to an actuating member of an actuator in a desmodromic valve actuation mechanism comprises a spherical bearing having two portions each of which defines a respective bearing surface which is complementary to the bearing surface defined by the other portion, at least one of the surfaces being part spherical, one of the portions being arranged to be coupled to the actuating member and the other portion being arranged to be coupled to the valve stem; and a resilient arrangement which exerts a biasing force on one of the bearing portions and provides resilience in the coupling provided by the assembly between the valve stem and actuating member.

21 Claims, 10 Drawing Sheets

(58) Field of Classification Search
USPC ..... 123/90.39, 90.61, 90.65, 90.16, 90.44, 123/90.45
See application file for complete search history.

(56) References Cited

FOREIGN PATENT DOCUMENTS

| | | | |
|---|---|---|---|
| WO | 02090728 | A1 | 11/2002 |
| WO | 2004097184 | A1 | 11/2004 |
| WO | 2008149316 | A2 | 12/2008 |
| WO | 2011061528 | A2 | 5/2011 |

OTHER PUBLICATIONS

European Patent Office, International Search Report and Written Opinion of the International Searching Authority, International Application No. PCT/GB2014/051239, dated Jun. 13, 2014 (12 pages).

SECTION A - A
A
B
44
46
48
50
52
54
56
80
84
88
90
92
94
96
98
100
102
104
106
108
110
112
114
116
118

DESMODROMIC VALVE SYSTEMS AND METHODS OF OPERATION THEREOF

CROSS-REFERENCE TO RELATED APPLICATIONS

This application is a submission under 35 U.S.C. § 371 of International Application No. PCT/GB2014/051239, filed Apr. 22, 2014, which claims priority to Great Britain Application No. 1307317.6, filed Apr. 23, 2013, the disclosures of which are hereby expressly incorporated by reference herein in their entireties.

FIELD OF THE INVENTION

The present invention relates to an assembly for coupling a valve stem to an actuating member of an actuator in a desmodromic valve actuation mechanism, to a desmodromic valve actuation mechanism having such an assembly and to an internal combustion engine having such a desmodromic valve actuation mechanism. The present invention also lies in a vehicle, such as an automobile, fitted with such an internal combustion engine.

BACKGROUND OF THE INVENTION

Desmodromic valve systems for engine inlet and exhaust valves are well known and a sub-set of these mechanisms using a combined pull-push rod to actuate a valve is also long-established. Traditionally, these mechanisms have left a certain amount of lash between the opening and closing parts of the mechanism in order to avoid potential "fight" between the two actions arising either from tolerance errors or by changes in component dimensions with temperature. Such an eventuality could lead to rapid wear of the mechanism or a catastrophic failure due to the mechanism locking up. An exhaust valve can "grow" by 0.15 mm quite easily at full load.

Common past practice was to positively close the valve to within a few thousandths of an inch of the seat and then allow cylinder pressure to do the rest. FIG. 1 shows an example of a known desmodromic system. The figure shows two valves each of which is opened and closed by a respective pair of rocker arms which are in turn driven by opening and closing cams on a common cam shaft. As can be seen from the figure, the closing rocker arms are fitted with torsion springs acting around the axis of the closing rocker arms. However, these are helper springs which are used to suppress rattle noise and do not provide any significant closing biasing force on the valves.

More recently, emissions regulations have made this approach impractical and the valve now has to be closed using spring force. Ducati engine designs (using desmodromic valve systems) use a spring not dissimilar in terms of spring force from a conventional spring for this purpose. The issue here is that these springs act in parallel with the cam forces so the opening cam has to provide enough force to compress the spring as well as to accelerate the valve mass (see FIG. 2). This is a disadvantage because it increases the loads in the system and therefore the stresses, the system mass and the parasitic losses.

This approach is also unsuitable for independent valve actuation mechanisms in which, instead of a mechanical linkage between the engine output, an electromagnetic actuator is used.

For example in the case of the present applicant's electromagnetic valve actuation systems (as described in WO 2004/097184 and WO2011/061528), the additional torque required of the actuator in order to compress a spring in parallel with the valve mass is doubly undesirable. Not only would it require a significantly larger electrical actuator but the electrical energy demand would also be significantly increased, at the expense of the overall efficiency of an engine fitted with such a mechanism.

EP 2198129 (Pattakos) shows a desmodromic valve actuation mechanism in which a valve actuator exerts a closing force on a valve stem through an elastic washer which helps to ensure that the valve, when closed, is sealed against its seat. The washer is carried on the actuator so that the latter does work on the washer only when the valve is closed. However the mechanism uses a complex linkage for connecting the actuator to the engine output and various tolerances in that mechanism, and the fact that the valve, in effect, floats on the washer means that the actuator movement must be tightly constrained.

To that end the cylinder head of the engine is formed with an integral guide for the actuator, thus further increasing weight and complexity of the system.

SUMMARY OF THE INVENTION

According to a first aspect of the present invention, there is provided an assembly for coupling a valve stem to an actuating member of an actuator in a desmodromic valve actuation mechanism, the assembly comprising:

a spherical bearing having two portions each of which defines a respective bearing surface which is complementary to the bearing surface defined by the other portion, at least one of the surfaces being part spherical, one of the portions being arranged to be coupled to the actuating member and the other portion being arranged to be coupled to the valve stem; and a resilient arrangement which exerts a biasing force on one of the bearing portions and provides resilience in the coupling provided by the assembly between the valve stem and actuating member.

The spherical bearing provides a lightweight, compact means of accommodating tolerances and packaging constraints which can lead to misalignments between, for example, the valve stem axis and cam axes, as well as translational offsets and angular errors.

Since the resilience that urges the valve into its closed position is provided in the coupling between the valve stem and the actuating member, it is not necessary for the assembly to do significant work on the resilient arrangement when the valve is in an unseated position.

Preferably, therefore, the assembly is so configured that, in use, the valve is opened by movement of the assembly in an opening direction and closed by movement of the assembly in a closing direction, the coupling allowing further movement in the closing direction, against the action of the resilient arrangement, when the valve is seated.

Thus, the assembly also provides a resilient lost motion coupling, between the valve and the actuator, that accommodates valve lash.

Preferably, the resilient arrangement comprises a resilient member which is, in use, compressed by said closing movement, when the valve is seated.

Preferably, the resilient member comprises a compression spring.

The spherical bearing may be so configured that, in use, the actuating member acts through the bearing in order to cause both opening and closing movement.

For example, if the actuating member comprises a rocker arm, the bearing may comprise a part spherical socket in the arm and a ball portion on a connecting rod connected, in use, to the valve stem.

Alternatively, the assembly may include a further spherical bearing via which, in use, the actuating member acts on the valve stem in order to open the valve.

In this case, the further spherical bearing preferably comprises a first bearing portion having a concaved, part spherical, preferably substantially hemispherical surface, and a second bearing portion, having a complementary surface at the end of the valve stem opposite the valve head.

This enables the second portion to be formed integrally with the valve stem, thus facilitating a light weight, low inertia construction of assembly.

Preferably, the assembly further comprises a connecting rod for attachment to the actuating member, and a cradle which is mounted on the rod and which carries one of the portions of the first said spherical bearing, said cradle being arranged to rock, relative to the valve stem, as said rod is moved by the actuating member.

The resilient arrangement may conveniently comprise a disc spring which is positioned so as to surround the valve stem in use. For example, the disc spring may be a Bellville washer.

The cradle allows the rod to be pivotally connected to an actuating member in the form of a rocker, since the pivotal movement of the rocker and rod can then transmit linear movement to the valve stem.

Preferably, the assembly includes adjustment means for adjusting the position of the cradle on the rod, and hence the preload in the resilient arrangement when the valve is unseated.

This can be achieved by means of, for example, a screw threaded connection between the rod and the cradle, and provides an arrangement in which preload can be relatively easily adjusted in view of the relative accessibility of the cradle.

Alternatively, where the assembly has a rod for connection at one end to the valve stem, the resilient arrangement may, in use, be interposed between the rod at its opposite end region and the actuating member, so that the actuating member acts on the rod through the resilient arrangement to cause the closing movement of the assembly.

Preferably, in this case, the resilient arrangement comprises a compression spring.

This location of the resilient arrangement allows a preload adjuster to be situated at an easily accessible position (i.e., at the region of the rod opposite the valve stem).

According to a second aspect of the present invention there is provided an assembly as aforesaid and an actuating member in the form of a rocker, wherein the assembly includes a connecting rod for connecting a valve stem to the actuating member, and wherein the connecting rod is coupled to the actuating member through said assembly.

According to a third aspect of the present invention, there is provided a desmodromic valve actuation mechanism for an internal combustion engine, the mechanism comprising an inlet or exhaust valve; an actuator for opening and closing the valve, the actuator having an actuating member coupled to the valve through an assembly in accordance with the first aspect of the present invention.

The present invention also lies in an internal combustion engine having such a desmodromic valve actuation mechanism and in an automobile fitted with such an engine.

The present invention also provides an assembly for coupling a valve stem to an actuating member of an actuator in a desmodromic valve actuation mechanism, the assembly comprising:

a spherical bearing having two portions defining respective complementary bearing surfaces, one of the portions being coupled to the actuating member and the other being coupled to the valve stem, wherein the bearing allows relative rotational motion between the valve stem and the actuating member; and a resilient arrangement which exerts a biasing force on one of the bearing portions and provides resilience in the coupling provided by the assembly between the valve stem and the actuating member.

An assembly is provided which gives the required valve seating force when the valve is in the closed position but does not impose a force related to that valve seating force upon the entire valve mechanism when the valve is not on the seat. It includes a means of compensating for dimensional tolerances in components and changes in dimensions due to thermal expansion and contraction.

Lash is provided together with spring loading within the mechanism, as opposed to the known arrangements in which a spring load which is "grounded" to the engine structure.

BRIEF DESCRIPTION OF THE DRAWINGS

Embodiments of the present invention will now be described, by way of example only, with reference to the accompanying drawings, in which.

DETAILED DESCRIPTION OF THE INVENTION

Figure 1:
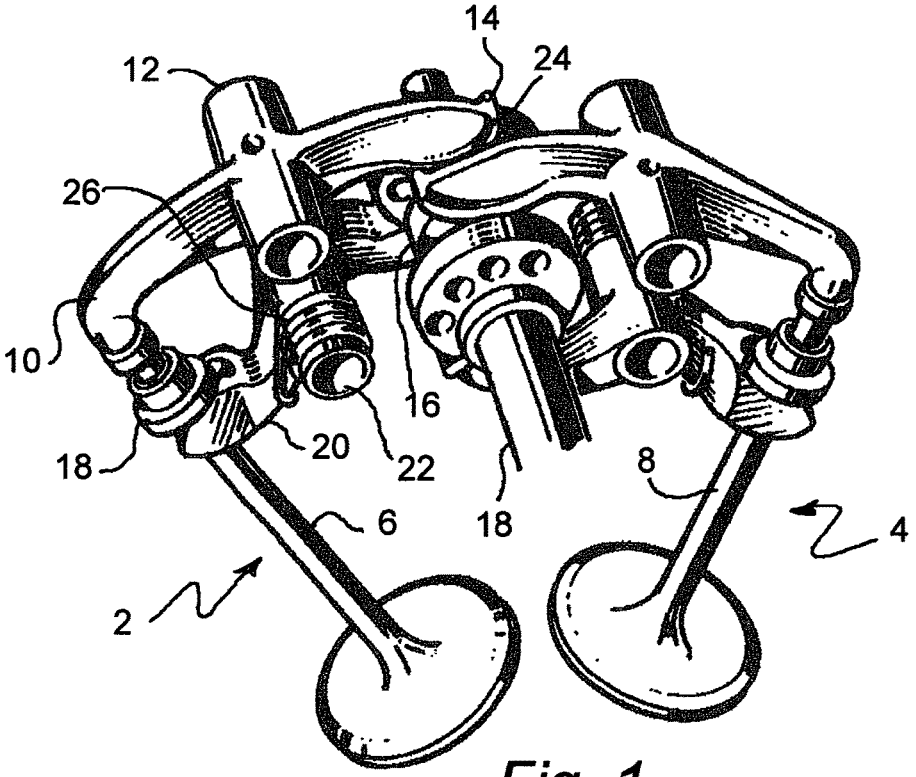
Fig. 1 PRIOR ART
FIG. 1 is a perspective view of two valves for a cylinder of an internal combustion engine and a known type of desmodromic valve actuation mechanism for opening and closing the valves.

In the mechanism shown in FIG. 1, there are two valves, referenced 2 and 4 each of which may comprise an inlet valve or an outlet valve having valve stems, respectively referenced 6 and 8. Each valve is opened and closed by actuating members in the form of a respective pair of rocker arms. The mechanism of which the valve 4 is a part is identical to that for the valve 2, and only the latter will therefore be described. The arms include an opening arm 10 having an outward end which can bear against the end of the valve stem 6 (opposite the valve head) and which is provided with a sleeve 12 for rotatably mounting the arm on a corresponding spindle (not shown). The other end 14 of the arm is acted on by an opening cam 16 on a cam shaft 18 which is driven by the engine crank shaft (to which it is connected by a suitable mechanism).

A collar 18 is fixed to the upper region of the stem 6 (at a position spaced from the upper end of the stem) and cooperates with a closing arm 20 which also has a sleeve 22 for a corresponding spindle. The end of the arm 20 opposite the collar 18 is acted on by a closing cam 24. The cams 16 and 24 alternately pivot the arm 10 in an anti-clockwise direction and the arm 20 in a clockwise direction to open and close the valve 2. When the valve 2 is seated, it cannot be closed any further and the mechanism would therefore jam if the arm 20 had not by that point completed its clockwise stroke. To ensure this does not happen (when the system is cold) some clearance would be left between the valve 2 and its seat (i.e., valve lash), with the valve then being closed by the pressure of combustion gases, with the associated problems previously explained. The mechanism does include a helper spring 26, but this functions merely to suppress rattle in the system, and does not provide any resilience or play in the coupling between the lever 20 and the valve 2.

Figure 2:
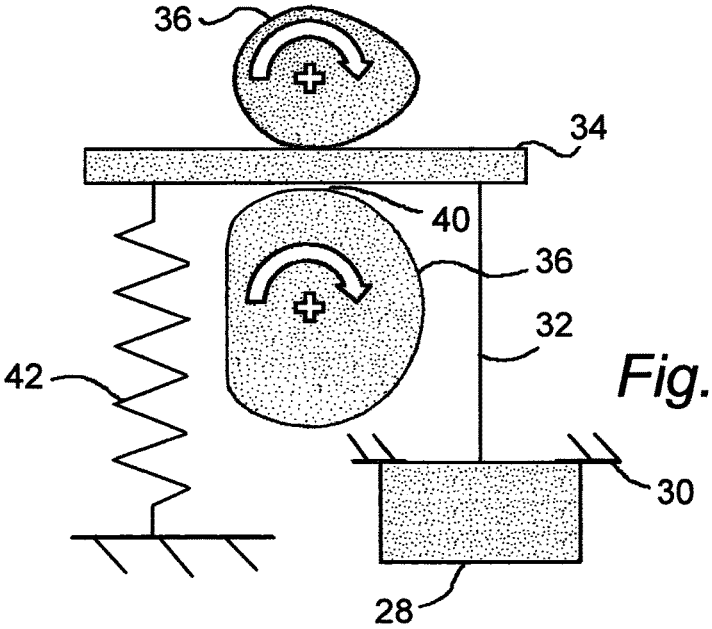
FIG. 2 is a schematic view illustrating the various loads on another type of known desmodromic valve actuation mechanism.

In the system schematically shown in FIG. 2, a valve head 28 is shown when against a seat 30 so that the stem (reference 32) and hence the cam follower (which may be a lever or rocker) 34 at the end of the stem 32 is incapable of any further closing movement. The follower 34, although bearing against an opening cam 36 is spaced from the closing cam 38 by a small distance, the clearance between the follower and the closing cam being shown at 40 and constituting the valve lash. A compression spring 42 acting between the valve and its mounting (for example the engine cylinder head) biases the valve into its closed position. However, this spring acts in parallel with the forces exerted by the cams 36 and 38, so that the actuator that drives the opening cam 36 has to do work on the spring 42 over the course of the entire opening movement of the valve. In order to be of the required strength, the spring 42 also needs to be relatively massive, and this adds to the inertia in the system.

Figures 3, 4, 5:
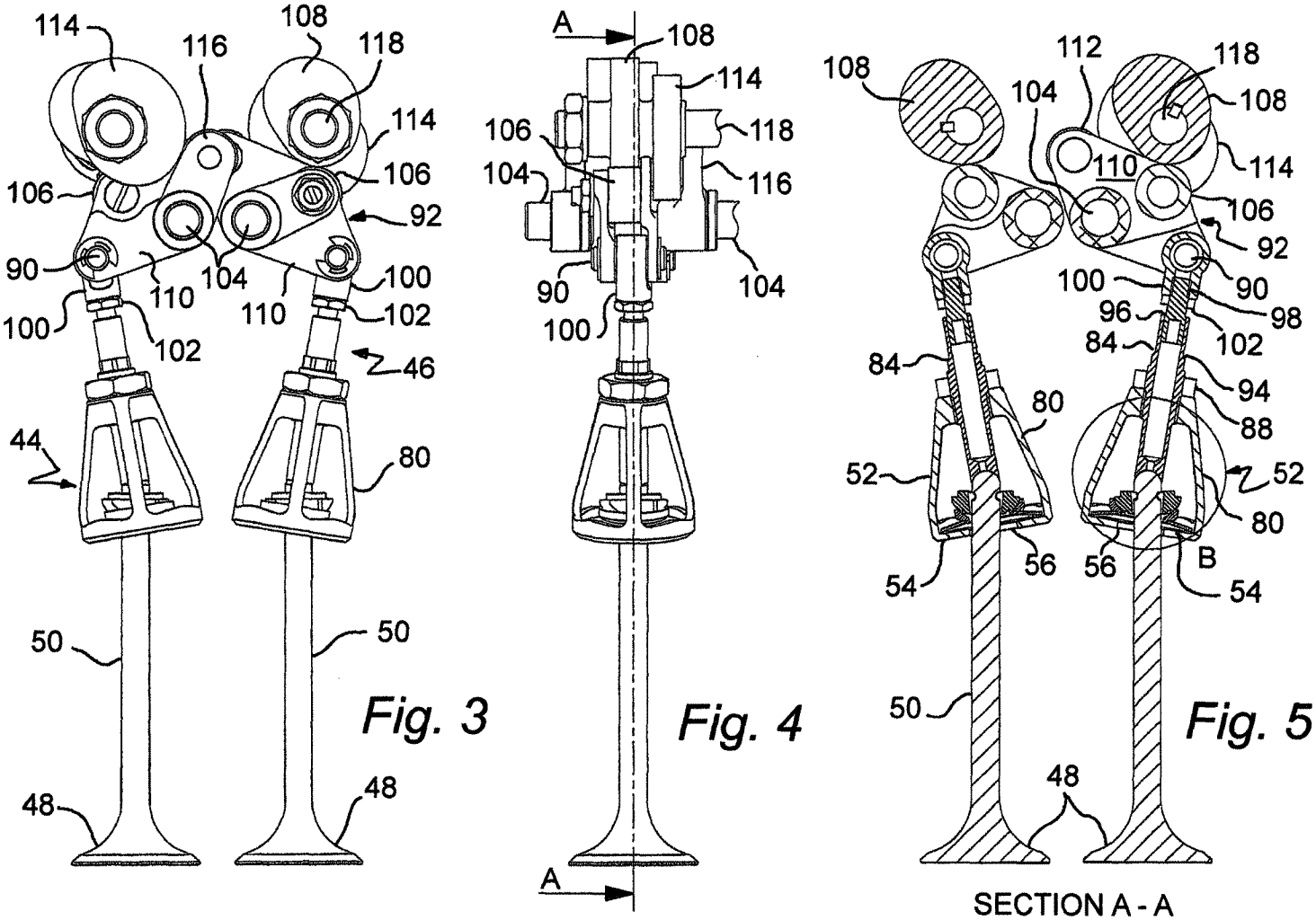
FIG. 3 is a front elevation view of two examples of a first embodiment of valve actuation mechanism in accordance with the present invention.
FIG. 4 is a side elevation view of one of the mechanisms shown in FIG. 3.
FIG. 5 is a sectional view of the mechanisms of FIGS. 3 and 4, taken along the line A-A in FIG. 4.

The two valve actuation mechanisms shown in FIG. 3 are substantially identical to each other, and are generally indicated by the reference numerals 44 and 46. The mechanism 46 is rotated about a vertical axis through 180° compared to the mechanism 44, so that the Figure shows opposite sides of the mechanisms 44 and 46. Since the mechanisms are identical, only the mechanism 46 will be described in detail, and components of the mechanism 44 will be denoted by the same reference numerals as are used in respect of the mechanism 46.

Each mechanism includes a valve having a valve head 48 formed at one end of a valve stem 50. At the other end region of the stem 50 is a cradle in the form of a stirrup 52. As can be seen from FIGS. 5 and 11, the stirrup 52 has an annular base 54 which defines a central aperture 56 through which the stem 50 extends. The aperture 56 is of a greater diameter than the stem 50 so that, in use, the stirrup 52 can rock relative to the valve stem 50. The upper surface of the annular base 54 carries a washer 58 which supports the radial outer, lower edge of a Bellville spring washer 60.

Figure 11:
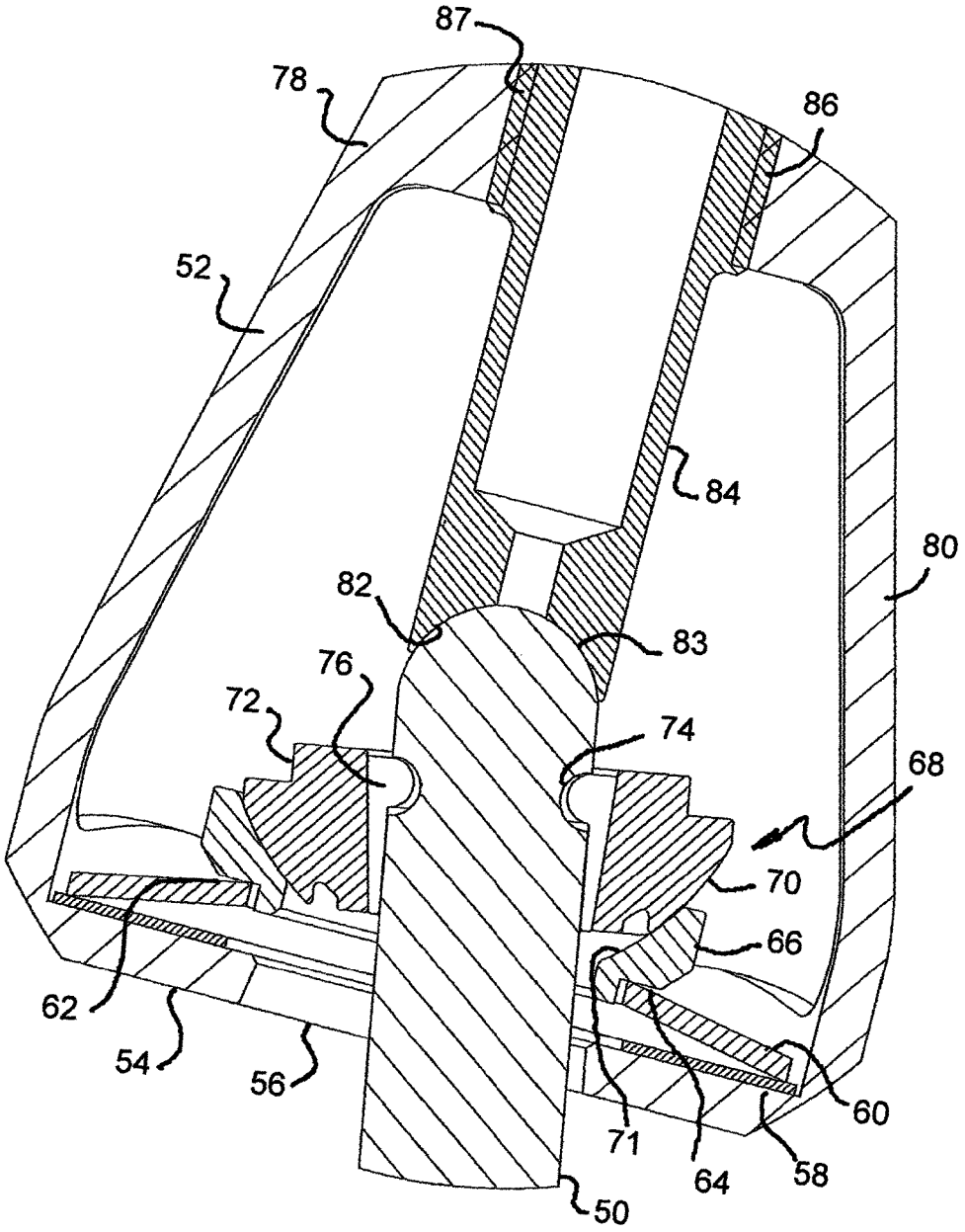
FIG. 11 is a more detailed view of part of the mechanism shown in FIGS. 3-5, when the valve is in an open position.

As can be seen from FIGS. 5 and 11, the washer 58 and Bellville 60 both surround the valve stem 50, and the inner periphery, referenced 62, and hence the upper edge of the Bellville 60 bears against an annular shoulder 64 of a lower portion 66 of a spherical bearing 68. The lower portion 66 is annular, and has a concaved generally upwardly facing part spherical surface 71 which bears against a complementary, convexed, part spherical, generally downward facing surface 70 of an annular upper bearing portion 72.

The valve stem 50 also extends through the upper and lower bearing portions 72 and 66, and includes at its upper region an annular radial recess 74 for receiving valve cotters 76 for locating the upper bearing portion 72 on the stem (both axially and angularly).

The top portion of the stem 50 is situated approximately centrally within a cage defined by the base 54 of the cradle, an annular top 78 of the cradle and axial connecting bars, for example the bar 80 which are formed integrally with the base 54 and top 78 and extend from the top to the base of the cradle.

The top of the valve stem has a convex, generally hemispherical surface 82 which can engage a complementary generally hemispherical concave bearing surface 83 at the base of a connecting rod 84.

The surfaces 82 and 83 provide a further spherical bearing through which, in use, the opening force is exerted on the valve stem 50. The surfaces 70, 71 and 82 have radii of curvature which share the same centre to avoid kinematic errors from causing the rotations permitted by the two bearings to "fight".

The rod 84 extends into the stirrup 52 through a screw threaded bore 86 in the top of the stirrup. The screw threaded bore 86 cooperates with a correspondingly externally screw threaded portion of the rod 87 so that rotation of the stirrup 52 about the axis of the rod 84 varies the distance by which the rod 84 projects into the stirrup 52.

The externally screw threaded portion 87 of the rod 84 also carries a locking nut 88 which can be tightened against the top 78 of the stirrup 52 to prevent rotation of the stirrup 52 relative to the rod 84, and hence set the distance by which the rod 84 projects into the stirrup 52.

The top of the rod 84 is pivotally attached, at pivot joint 90 to an actuating member which is in the form of a rocker 92. As can be seen from FIG. 5, the rod 84 is hollow and is of a two part construction, having an outer sleeve 94 to which an upper connector 96 is attached. The connector 96 is cylindrical and is screw threaded at its upper portion 98. This portion extends into a correspondingly screw threaded socket 100 forming part of the pivot joint 90. The extent by which the portion 98 may extend into the socket 100 can be varied, during assembly of the mechanism, by rotating the rod 84 about its axis. This provides adjustment for the effective rod length, i.e., the distance between the axis of the pivot joint 90 and the lower surface 83 of the rod 84. Once the desired length has been achieved, a locking nut 102 can be tightened against the lower edge of the socket 100 to prevent further rotation of the rod 84.

The rocker 92 is pivotally mounted on a rocker shaft 104 and carries a roller follower 106 for an opening cam 108. The roller 106 is mounted on a plate 110 constituting the main body of the rocker 92. Also attached to this plate is an arm, the end of which carries a roller follower 112 which cooperates with a closing cam 114. In FIG. 5 the arm is behind the plate 110, but can be seen at 116 in FIG. 4. The corresponding arm on the rocker of the mechanism 44 is also denoted by the reference numeral 116 in FIG. 3. Arm 116 is rotationally mounted on the shaft 104, but is fixed to the plate 110 in such a way that, in use, the cams 108 and 114 cause a unitary rocking motion of the rocker 92 about the shaft 104.

Opening and closing cams 108 and 114 are mounted on a common shaft which may be connected by a suitable mechanical linkage to the engine crankshaft or, preferably, to an electromagnetic actuator such as is described in WO 2004/097184 and WO 2011/061528.

In use, the actuator rotates the opening and closing cams 108 and 114 in unison, as a result of which the opening cam 108 will periodically (once per revolution) push down on the roller 106, causing the rocker 92 to rotate about the shaft 104 in an anti-clockwise direction (as viewed from FIG. 5). The rocker thus pushes down on the rod 84 and also rotates the latter in an anti-clockwise direction about the pivot 90. This in turn causes the lower end of the rod 84 to be urged against the top of the valve stem 50 and to push down on the latter whilst also causing the stirrup 52 to rotate (about the top of the valve stem) in an anti-clockwise direction as the stem 50 moves downwards and the valve therefore opens.

During this movement, the Bellville remains uncompressed since it is, in effect, connected in series between the rod 84 and the valve stem 50.

The large radius portion of the closing cam 114 is angularly spaced by 180° from the corresponding portion of the cam 108 so that the cam 114 operates in antiphase relative to the cam 108. Thus, after the cam 108 has opened the valve, the cam 114 will begin bearing against the follower 112, causing the rocker 92 to rotate in an anti-clockwise direction thereby to raise, and thus close, the valve. During this movement, the rod 94 and stirrup 52 move in a clockwise direction. The valve will reach its seat before these movements of the rocker, rod and stirrup are completed. Thus, once the valve has been seated, the stirrup 52 will continue to rise, thereby lifting the surface 83 of the rod away from the surface 82 of the valve stem, whilst the base 54 moves up towards the portions 72 and 66 of the bearing 68, and thus causes the Bellville 60 to be compressed. When the stirrup 52 is in its fully raised condition, the Bellville 60 will exert a closing biasing force (typically 100 Newtons) on the valve in order to seal it against its seat. Although the mechanism has to do work on the Bellville to compress it, this only happens over a relatively short distance of movement of the stirrup 52, and thus gives rise to significantly reduced energy demands compared with a system in which the valve is biased closed by a spring connected in parallel.

As with other valve actuation mechanisms, tolerances and packaging constraints make it practically impossible to ensure that the axis of the cams intersects the valve axis, and the system may also need to be able to accommodate angular errors as well as translation offsets. The use of a spherical bearing as one of the abutments for the Bellville 60 can accommodate these variations, whilst enabling the assembly to be of a light weight, low inertia construction. In FIG. 11, the Bellville 60 is shown in its uncompressed condition in which the force exerted by the Bellville 60 on the bearing 68 corresponds to the valve preload set for the mechanism in the way described above.

Figure 6:
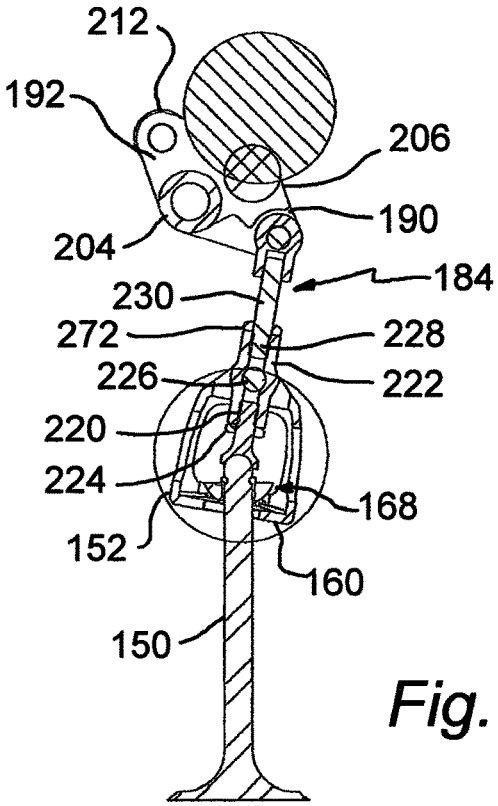
FIG. 6 is a sectional side view of a second embodiment of valve actuation mechanism in accordance with the present invention.

FIG. 6 shows a valve actuation mechanism in which a valve actuating member is coupled to a valve through an assembly which also includes a stirrup in which the resilience in the coupling is provided. The mechanism has many features which are the same as or very similar to the features of the first embodiment of mechanism, and these are therefore denoted by the reference numerals used in FIGS. 3-5 and 11, raised by 100. Thus, a rocker 192 has roller followers 212 and 206 which respectively engage closing and opening cams (which have been omitted from the Figure) to cause the rocker to undergo angular oscillations about a shaft 204. These oscillations are transmitted through a pivot 190 to a rod 184 which is attached to a stirrup 152 which acts on the valve stem 150 through a Bellville 160 and spherical bearing 168.

The mechanism shown in FIG. 6 differs from that of FIGS. 3-5 and 11 in the construction of the rod 184 and the way in which it is mounted on the stirrup 152. More specifically, whereas the first embodiment used a screw threaded portion 98 at the top of the rod 94 and a correspondingly threaded socket at the pivot 90 for lash adjustment, this adjustment in the arrangement of FIG. 6 is achieved using a cupped insert 220 which is at the bottom of the rod 184 and has a screw thread through which it is adjustably connected to a sleeve 222 forming part of the rod assembly. The screw threaded portion of the insert 220 also carries a locking nut 224 that can be tightened against the sleeve 222 in order to lock the insert 220 at a selected position, corresponding to a selected amount of lash.

In addition, the rod assembly 184 is connected to the stirrup 152 through a pivot 226. The pivot 226 is, strictly speaking, not necessary for the required movements of the rod assembly, stirrup and valve stem relative to each other to be accommodated, but can in some circumstances facilitate assembly of the mechanism.

The upper end of the sleeve 222 also houses an internally screw threaded portion which receives a correspondingly screw threaded end 228 of a bar 230 of the rod assembly 184.

The screw threaded connection between the bar 230 and sleeve 222 enables the position of the stirrup 152 relative to the stem 150 when the valve is closed to be adjusted, and hence provides a means of setting the valve preload (the force exerted by the Bellville 160 on the bearing 168 when the valve is not seated). The desired preload is then set by tightening a locking nut 232 also carried on the screw threaded portion 228, against the top of the sleeve 222.

Figure 9:
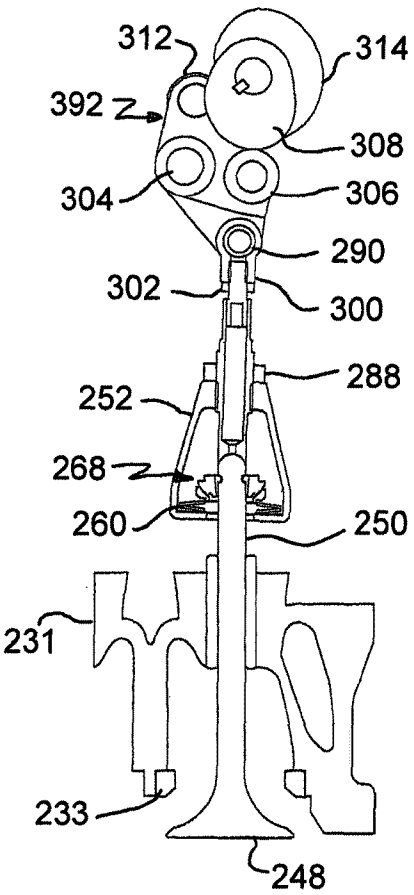
FIG. 9 is a corresponding view of the mechanism when the valve is in its open position.
Figure 8:
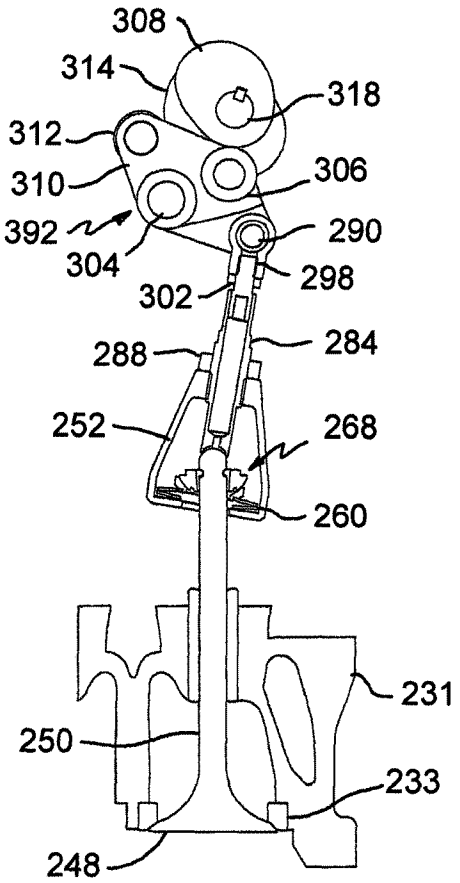
FIG. 8 is a partially cut away front elevation of a third embodiment of desmodromic valve actuation mechanism in accordance with the present invention, and also shows part of the cylinder head (including the valve seat) in which the valve of the mechanism works, the Figure showing the mechanism when the valve is in its closed position.
Figure 10:
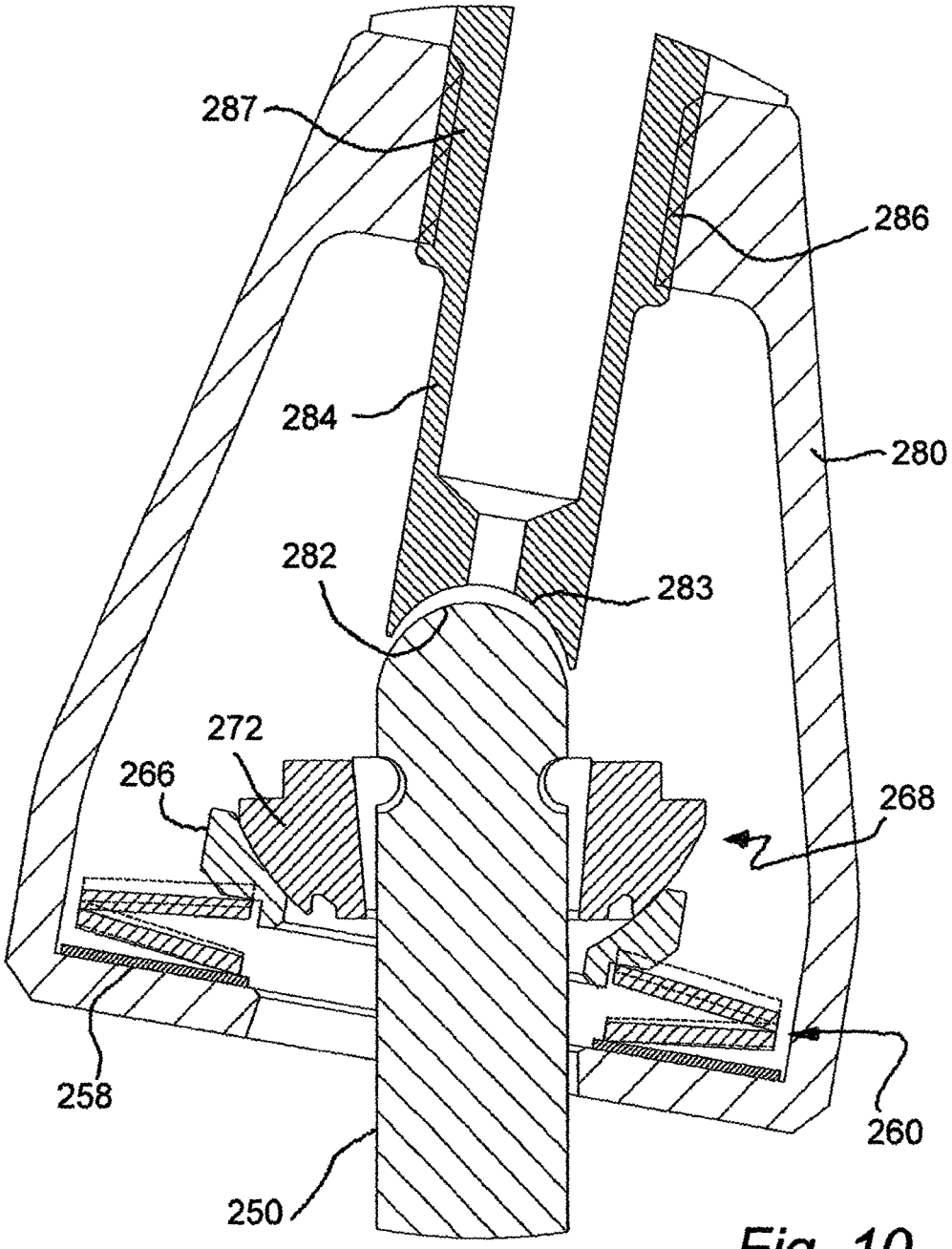
FIG. 10 is a more detailed cross-sectional view of the mechanism shown in FIGS. 8 and 9, when the valve is in the closed position.

The embodiment shown in FIGS. 8-10 is identical to the first embodiment in all respects other than the nature of the resilient arrangement that acts through the spherical bearings. Accordingly, features that correspond to those of the first embodiment are denoted by the reference numerals of FIGS. 3-5 and 11, raised by 200.

Whereas the spherical bearing of the first embodiment was acted on through a single Bellville, the third embodiment uses a double Bellville 260 acting between the washer 258 and the lower portion 266 of the spherical bearing 268.

In FIG. 10, some clearance is shown between the top of the valve stem 250 and the bottom of the rod 284. This arises because the valve is in its closed condition. In FIG. 11, the stirrup part of the coupling assembly is shown also when the valve is in its closed position, but in this case there is no clearance. This is because the Figure shows the situation when the valve is hot, and has expanded to its maximum length, whereas in FIG. 10 the valve stem 250 is cooler, and therefore shorter.

FIGS. 8 and 9 also show, at 231, a part of the cylinder head to which the valve extends. The seat for the valve is shown at 233.

Figure 13:
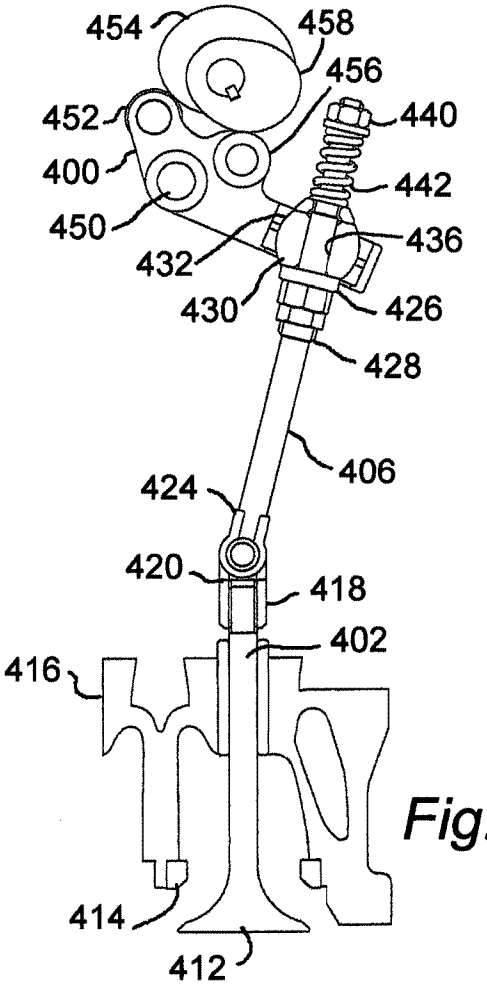
FIG. 13 is a corresponding view to FIG. 12, showing the mechanism when the valve is in its open condition.
Figure 12:
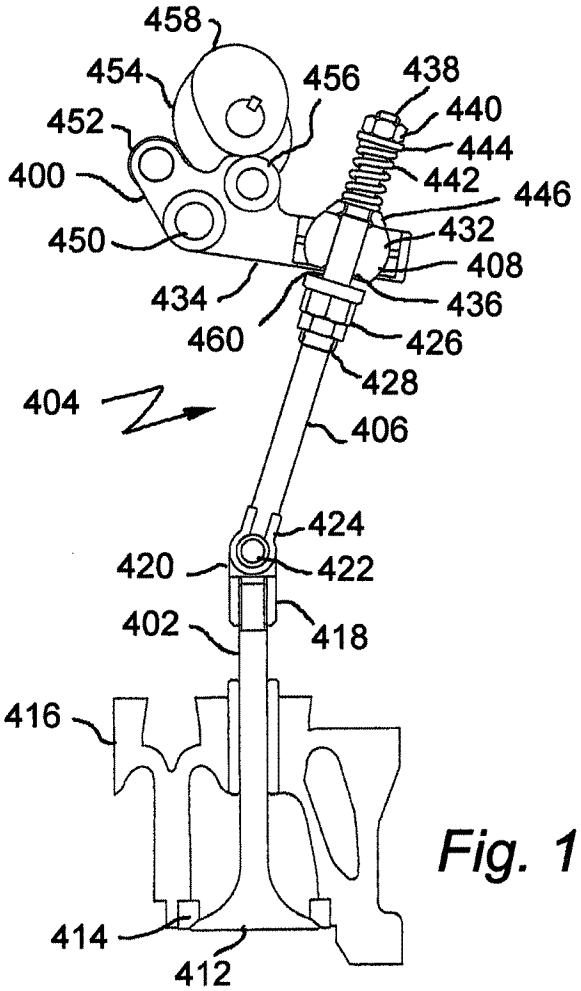
FIG. 12 is a cut away front view of a fourth embodiment of desmodromic valve actuation mechanism in accordance with the present invention, the Figure also showing the portion of the cylinder head in which the valve moves and the valve seat, the mechanism being shown when the valve is in its closed position.
Figure 14:
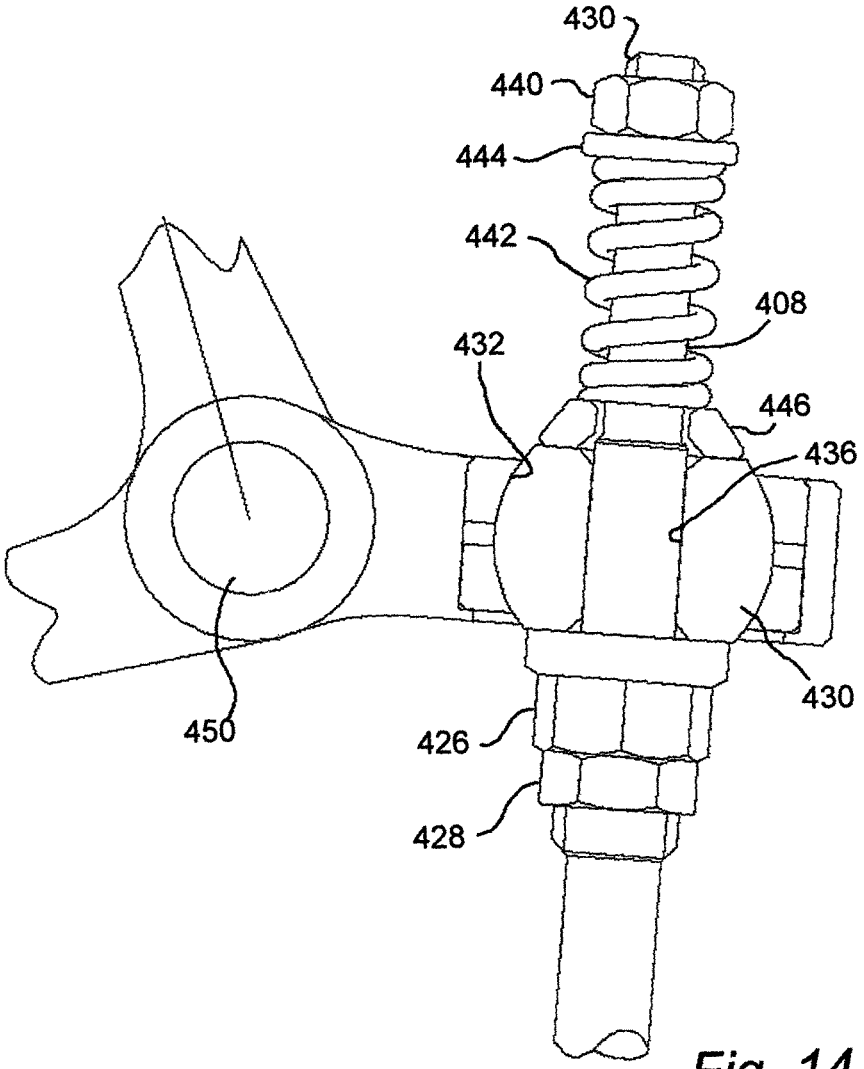
FIG. 14 is a cut away front view, to an enlarged scale, of the embodiment of mechanism shown in FIGS. 12 and 13.

In the embodiment shown in FIGS. 12-14, an actuating member in the form of a rocker 400 is coupled to a valve stem 402 by a coupling assembly 404 in which a connecting rod 406 is pivotally attached at one end to the valve stem 404 and connected at the other end to the rocker 400 through a spherical bearing 408. The mechanism is operable to move the head, referenced 412 of the valve from the closed position shown in FIG. 12, in which the valve is sealed against its seat 414 in the cylinder head 416 to the open position shown in FIG. 13, in which the valve head 412 is clear of the seat 414.

The coupling assembly is attached to the valve stem by means of a connector comprising an internally screw threaded lower sleeve 418 the top of which is connected to a plate 420 through which a pivot pin 422 extends pivotally to mount a socket portion 424 on the sleeve 418. The socket portion is internally screw threaded and co-operates with a correspondingly screw threaded portion on the outer surface of the lower region of the rod 406 to hold the rod in position relative to the socket 424. It will be appreciated that there are other ways in which the rod 406 may be attached to the socket 424 (for example by means of welding).

The upper region of the rod is also screw threaded and receives a link arm adjuster nut 426 and an associated locking nut 428. The nut 426 can be moved up and down the upper portion of the shaft to determine the minimum distance between the bearing 408 and the top of the valve stem 402 (i.e., the distance when the valve is opened), and the locking nut can be tightened against the adjustment nut to retain the latter in position once the appropriate minimum distance has been set.

The spherical bearing 408 includes a ball portion 430 which is held captive within a correspondingly shaped, i.e., part spherical, socket portion 432 on an arm 434 integrally formed with the rocker 400. The socket portion 432 has the same radius of curvature, and is concentric with, the ball portion 432 so that the ball portion 430 can rotate about its centre of curvature within the socket 432 whilst being held captive within the latter. FIGS. 12 and 13 are partially sectioned, at the spherical bearing, and it can be seen that the ball portion 430 has a central passage through which the rod 406 extends, and the top of the rod 406 projects beyond the arm 434. The top region 438 is externally screw threaded, and carries a pre-load adjustment mat 440. A coil compression spring 442 acts between a washer 444 just underneath the nut 440 and a stop 446 borne by the top of the ball portion 430.

The rocker 434 has a similar function to the rockers of the other embodiments, and is hence mounted for angular oscillations about a rocker shaft 450 and carries a roller follower 452 which co-operates with a closing cam 454 and a further roller follower 456 which co-operates with an opening cam 458.

The ball portion 430 can slide relative to the rod 406, and can accommodate the relative rotational movements of the rod 406 and rocker 434. However, since the ball portion 430 is held captive within the socket 432, the rocker 434 is able to continue its angular travel in the closing direction (i.e., anti-clockwise as viewed in FIGS. 12 and 13) after the valve 412 is sealed against the seat 414. This further movement of the rocker causes the ball 430 to ride up the rod 406, thus compressing the spring 442 and permitting valve lash which is manifested in the assembly as a gap 460 between the nut 426 and the underside of the ball portion 430. Once the rocker 400 has passed through the maximum angle in the anti-clockwise direction, the cam 458 acts through the roller follower 456 to rotate the rocker 400 in the opposite direction. Initially, the ball portion 430 slides down along the rod 406, reducing the compression on the spring 442 until the ball portion 430 meets the nut 426. Continuing clockwise movement of the rocker 400 then moves the valve into the open position as shown in FIG. 13. The extent by which the valve is opened by this movement is governed by the position of the nut 426, and the position of the nut 440, when the valve is opened, governs the amount of pre-load on the spring 442 (i.e., the biasing force at that stage exerted by the spring 442 between the ball portion 430 and the nut 440).

The spring 442 can have a much lower spring rate than the Bellville washers of the other embodiments, and can thus provide improved consistency of seat load. In addition, the pre-load exerted by the spring 442 can be easily adjusted, in view of the lower spring rate, and the fact that the spring and adjustment nut are now located at the top of the rod 406. The spherical bearing and spring arrangement shown in FIGS. 12-14 also facilitates the assembly of the mechanism, since the valve and lower pivotal connection at 422 can be assembled before the actuator is mounted on the engine. The rod 406 can be coupled to the lever 434 as the rocker is mounted and bolted down. Once this is done, the stop 446, spring 442, washer 444 and nut 440 can be mounted on the rod and bearing.

Figure 16:
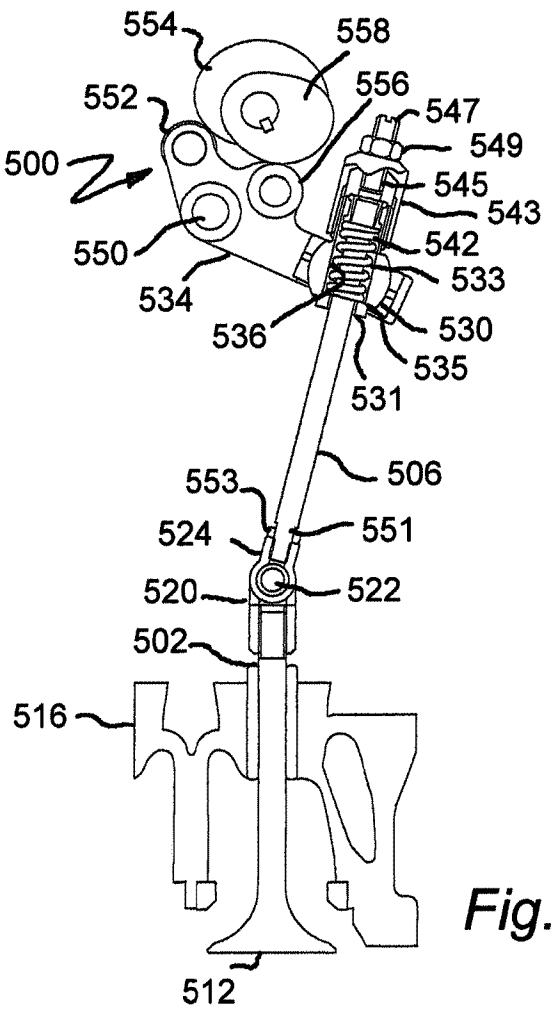
FIG. 16 is a corresponding view to FIG. 15, showing the mechanism when the valve is open.
Figure 15:
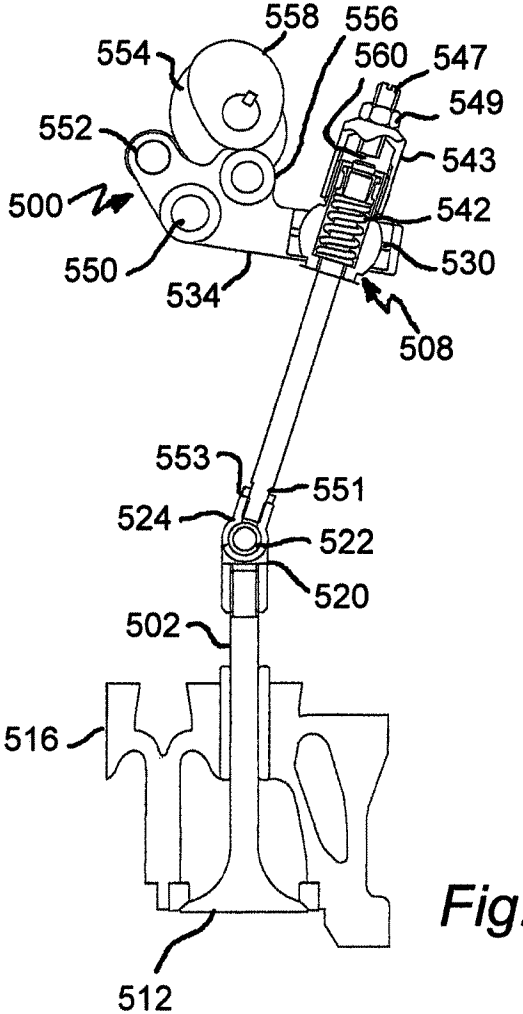
FIG. 15 is a cut away front view of a fifth embodiment of desmodromic valve actuation mechanism in accordance with the present invention, also showing a portion of the cylinder head in which the valve moves, the mechanism being shown when the valve is closed.
Figure 17:
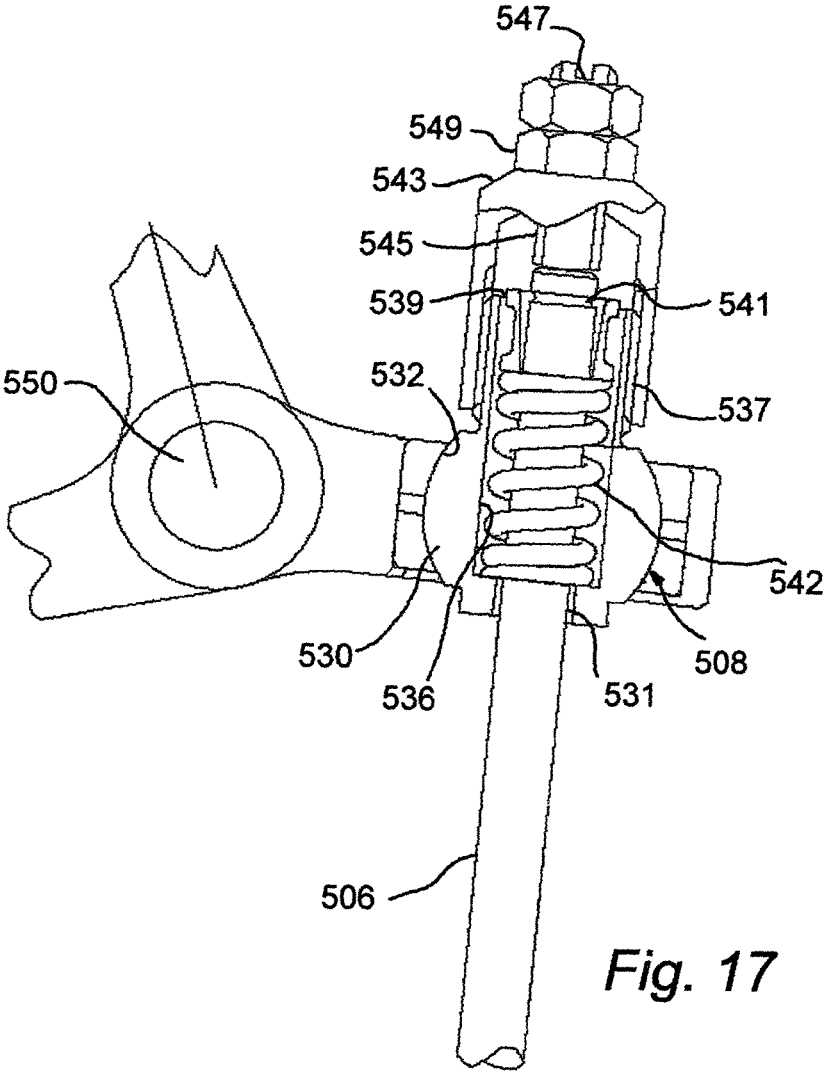
FIG. 17 is a cut away front view, to an enlarged scale, of part of the mechanism shown in FIGS. 15 and 16.

The embodiment of mechanisms shown in FIGS. 15-17 is similar in many respects to that shown in FIGS. 12-14, and corresponding features are therefore denoted by the reference numerals of FIGS. 12-14 raised by 100.

In the embodiments shown in FIGS. 15-17, the passage 536 through the ball portion 530 has a lower, narrow portion 531 and an upper, enlarged portion 533. These two portions meet at a step 535 which acts as a seat for the compression spring 542, the lower end of which is thus accommodated within the ball portion 530.

The ball portion 530 is integrally formed with a cylindrical neck portion 537 which extends, coaxially with the rod 506, upwardly from the body of the ball 530 to define an extension to the wider portion of the passage 536. The neck portion acts as a guide for the compression spring 542, and the top of the compression spring 542 bears against a retaining collet 539 which is clamped into a circumferential recess 541 at the region at the top of the stem 506. The neck 537 is externally screw threaded, and retains a cap nut 543 which has a thread that very closely fits the thread on the neck 537 to provide a relatively stiff screw threaded connection between the cap 543 and the neck 537. The top of the cap 543 includes a screw threaded bore which receives a correspondingly screw threaded shaft 545. When the valve is opened, the bottom of the shaft 545 bears against the top of the rod 506, so that the distance by which the shaft 545 extends into the cap nut 543, and the spring rate of the spring 542, will determine the amount of spring pre-load on the mechanism. This can be adjusted by rotating the shaft 545 using a screwdriver (not shown) which may engage in a slot 547 at the top of the shaft 545. Once the desired pre-load has been selected, the shaft 545 can be locked in position by means of a locking nut 549.

When the valve is in its open position, for example as shown in FIG. 16, the spring 542 urges the rod 506 upwardly, relative to the spherical bearing, thus urging the top of the rod 506 against the bottom of the shaft 545 with a force which corresponds to the pre-load. When the valve is in its closed position, further "closing" movement of the rocker 500 will cause the shoulder 535 to move towards the top of the rod 506 (which cannot be raised anymore because the valve is seated), thus compressing the spring 542 and causing clearance at 560 between the bottom of the shaft 545 and the top of the rod 506. In the FIGS. 15-18 embodiment, the length adjustment mechanism for adjusting the effective length between the centre of the ball portion 530 and the pivotal connection 522 is no longer provided in the region of the arm 534, but is instead achieved by means of a screw threaded lower portion of the rod 506 (denoted by reference numeral 551) which enables the rod 506 to be screwed into the connector socket 524 to a varying degree, the selected position being set by means of a length adjustment lock nut 553.

The valves shown in FIGS. 3 to 5 slide in guides which are not shown. Both the opening and closing cams are mounted on the same shaft and are offset from each other along the shaft axis—see FIG. 4. A single rocker per valve features 2 roller followers and one roller bears upon each cam lobe; the lobe profiles themselves are not shown but simply represented by their swept circles. The pull-push rods are pivoted to the rockers and push directly on a hemispherical end on the valve stem. The "pull" function of the pull-push rod is achieved by means of an attachment to a cradle, which may or may not be free to pivot on the pull-push rod and which fits underneath a valve retaining collar fixed to the valve stem by means of conventional valve cotters.

Figure 7:
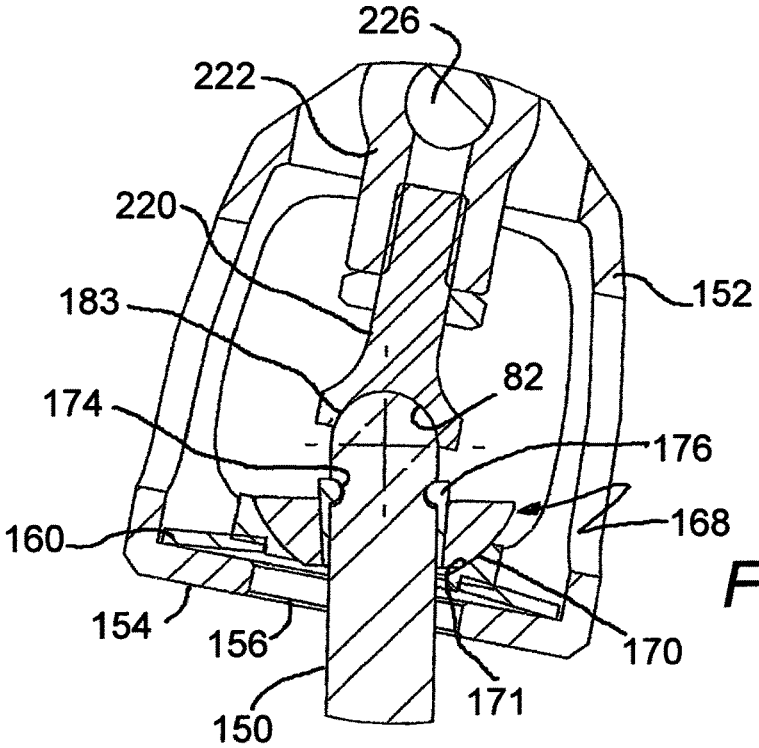
FIG. 7 is a more detailed view of part of the mechanism of FIG. 6.

When the closing cam exerts a force on the pull-push rod this is transmitted to the cradle by the cradle pivot pin and the cradle pulls the valve back towards its seat through a compact spring loaded mechanism and a spherical bearing which allows the cradle to rock relative to the valve stem. FIG. 7 shows an expanded view of the Cradle assembly.

The mechanism may need to be adjusted in order to function correctly. Initially the valve lash adjuster (FIGS. 6 and 7) should be slackened off and set to provide excessive clearance in order not to interfere with the valve seat preload adjustment. In order to set the seating load, the cam position should first be set onto the base circle of the valve closed position. The Seat Pre-load adjuster, FIG. 6, should be in a position which gives clear backlash in the system (as would be felt at the rocker). The adjuster is then rotated until the backlash has been just taken up i.e., the disc spring is just clamped but not loaded. The adjuster should then be rotated by a pre-determined angle which will be a function of the thread pitch in order to apply a specific compression to the spring. This compression, calculated in combination with the spring rate, will provide the desired valve seating load under the nominal adjustment conditions and the adjuster can now be locked by means of the locknut. This done, the valve lash adjustment can now be made using the other adjuster and, in the design as is, can be made by "angle of turn" if there is no access for feeler gauges.

Thus, a correctly set up mechanism will have lash selected so that, as the engine warms up and different components expand by different amounts, the situation where the valve is jacked up off the seat because the push rod is "too long" does not arise. The seating load will vary as the engine warms up but, correctly designed, will always stay within acceptable limits.

The mechanism achieves the seating load by the application of, in effect, a "negative lash" adjustment in the closing cam mechanism—but this negative lash does not give rise to excessive loads because the disc spring can accommodate variation in the negative lash without imposing excessive loads onto the system or allowing it to lock up by going "solid".

If required, the maximum compression of the disc spring can be limited by ensuring the Spring Retainer spigot which locates the ID of the disc spring is long enough to contact the spring seating surface in the cradle at the appropriate compression.

Although the spring element is a disc spring in the embodiments described above, it will be appreciated that the required resilience may be achieved using other resilient assemblies or components.

The spherical bearing at the valve retainer should have the same centre as the spherical radius on the end of the valve—otherwise there will be a kinematic error and the two rotations will conflict with each other.

From the present disclosure, many other modifications and variations will be apparent to persons skilled in the art. Such modifications and variations may involve other features which are already known in the art and which may be used instead of or in addition to features already disclosed herein. It should be understood that the scope of the disclosure of the present application includes any and every novel feature or combination of features disclosed herein either explicitly or implicitly and together with any such modification and variation, whether or not relating to the main inventive concepts disclosed herein and whether or not it mitigates any or all of the same technical problems as the main inventive concepts. The applicants hereby give notice that patent claims may be formulated to such features and/or combinations of such features during prosecution of the present application or of any further application derived or claiming priority therefrom.

While the present invention has been illustrated by description of various embodiments and while those embodiments have been described in considerable detail, it is not the intention of Applicants to restrict or in any way limit the scope of the appended claims to such details. Additional advantages and modifications will readily appear to those skilled in the art. The present invention in its broader aspects is therefore not limited to the specific details and illustrative examples shown and described. Accordingly, departures may be made from such details without departing from the spirit or scope of Applicants' invention.

What is claimed is:

1. An assembly for coupling a valve stem to an actuating member of an actuator in a desmodromic valve actuation mechanism, the assembly comprising:

a spherical bearing having two portions each of which defines a respective bearing surface, with one of the bearing surfaces being of a complementary shape to that of the bearing surface defined by the other of the two portions, at least one of the bearing surfaces being part spherical, one of the two portions being arranged to be coupled to the actuating member and the other of the two portions being arranged to be coupled to the valve stem; and a resilient arrangement which is configured to exert a biasing force on one of the two portions of the spherical bearing and, in use, provides resilience in a coupling provided by the assembly between the valve stem and the actuating member.

2. The assembly according to claim 1, in which the assembly is so configured that, in use, a valve, having the valve stem coupled to the actuating member by the assembly, is opened by movement of the assembly in an opening direction and closed by movement of the assembly in a closing direction, the coupling allowing further movement in the closing direction, against the action of the resilient arrangement, when the valve is seated.

3. The assembly according to claim 1, in which the resilient arrangement comprises a resilient member which is, in use, compressed by said closing movement, when the valve is seated.

4. The assembly according to claim 3, in which the resilient member comprises a compression spring.

5. The assembly according to claim 1, in which the spherical bearing is so configured that, in use, the actuating member acts through the spherical bearing in order to cause both opening and closing movement.

6. The assembly according to claim 5, in which the spherical bearing comprises a part spherical socket in the actuating member and a ball portion on a connecting rod connected, in use, to the valve stem.

7. The assembly according to claim 6, in which the resilient arrangement is, in use, interposed between the connecting rod, at an end region remote from a region of the connecting rod connected to the valve stem, and the actuating member, so that the actuating member acts on the connecting rod through the resilient arrangement to cause the closing movement of the assembly.

8. The assembly according to claim 7, in which the assembly includes a preload adjuster situated at the end region of the connecting rod.

9. The assembly according to claim 1, in which the assembly includes an additional spherical bearing via which, in use, the actuating member acts on the valve stem in order to open the valve.

10. The assembly according to claim 9, in which the additional spherical bearing comprises a first bearing portion having a concaved, part spherical surface, and a second bearing portion, having a complementary surface at the end of the valve stem opposite a valve head.

11. The assembly according to claim 1, in which the assembly further comprises a connecting rod for attachment to the actuating member, and a cradle which is mounted on the connecting rod and which carries one of the two portions of the spherical bearing, said cradle being arranged to rock, relative to the valve stem, as said rod is moved by the actuating member.

12. The assembly according to claim 11, in which the position of the cradle on the rod, and a preload in the resilient arrangement when the valve is unseated are adjustable.

13. The assembly according to claim 12, in which the position of the cradle on the rod and the preload in the resilient arrangement when the valve is unseated are adjustable via a screw threaded connection between the rod and the cradle.

14. The assembly according to claim 1, in which resilient arrangement comprises a disc spring which is positioned so as to surround the valve stem in use.

15. The assembly according to claim 14, in which the disc spring comprises a Bellville washer.

16. The assembly according to claim 1, comprising the actuating member in the form of a rocker and a connecting rod for connecting the valve stem to the actuating member, wherein the connecting rod is coupled to the actuating member through the assembly.

17. A desmodromic valve actuation mechanism for an internal combustion engine, the desmodromic valve actuation mechanism comprising an inlet or exhaust valve; an actuator for opening and closing the valve, the actuator having an actuating member coupled to the valve through an assembly according to claim 1.

18. An internal combustion engine having a desmodromic valve actuation mechanism according to claim 17.

19. An automobile fitted with an internal combustion engine in accordance with claim 18.

20. The assembly according to claim 1, in which one of the bearing surfaces is part spherical and convex, the other of the bearing surfaces being part spherical and concave.

21. The assembly according to claim 1, in which the assembly, in use, provides a resilient lost motion connection, between the valve and the actuator, that accommodates a valve lash.

* * * * *